US005165777A

United States Patent [19]

Kira

[11] Patent Number: 5,165,777

[45] Date of Patent: Nov. 24, 1992

[54] LIGHTING FIXTURE INCORPORATING FOUNTAIN

[75] Inventor: Hiroshi Kira, Westlake Village, Calif.

[73] Assignee: Lumiere Design & Manufacturing, Inc., Westlake Village, Calif.

[21] Appl. No.: 783,001

[22] Filed: Oct. 28, 1991

[51] Int. Cl.[5] ..... F21P 7/00

[52] U.S. Cl. ..... 362/96; 362/276; 362/806; 239/18

[58] Field of Search ..... 362/96, 101, 276, 295, 362/802, 806; 239/18

[56] References Cited

U.S. PATENT DOCUMENTS

| | | | |
|---|---|---|---|
| 490,378 | 1/1893 | Trouve | 239/18 |
| 492,999 | 3/1893 | Trouve | 239/18 |
| 1,818,319 | 8/1931 | Good | 239/18 |
| 1,839,994 | 1/1932 | Proffatt | 239/18 |
| 1,965,323 | 7/1934 | Taslitt | 362/96 |
| 2,726,116 | 12/1955 | Barber | 362/96 |
| 3,162,367 | 12/1964 | Nowack | 362/96 |
| 3,337,133 | 8/1967 | Duerkob | 239/18 |
| 3,894,689 | 7/1975 | Billingsley | 239/18 |
| 4,920,465 | 4/1990 | Sargent | 362/96 |
| 4,936,506 | 6/1990 | Ryan | 239/18 |

*Primary Examiner*—Richard R. Cole
*Attorney, Agent, or Firm*—Wagner & Middlebrook

[57] ABSTRACT

An illuminated fountain includes a housing with a water chamber in the housing having a cap with perforations and a transparent bottom panel, a lamp in the housing and a mirror for reflecting light from said lamp through the bottom panel of the water chamber. A source of electrical energy is connected to the housing and a pressure switch in the housing is connected between the electrical energy source and the lamp. The pressure switch has a fluid connection with the inlet to the water chamber such that it delivers current to the lamp only when water is flowing to the chamber.

8 Claims, 2 Drawing Sheets

FIG. 1
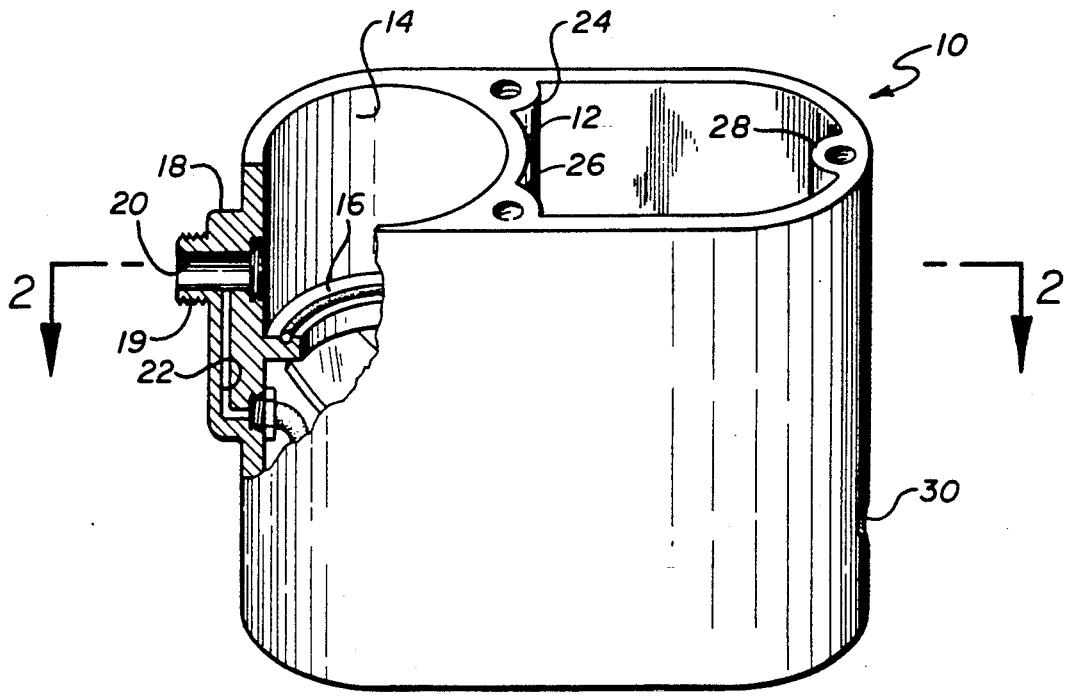
FIG. 2
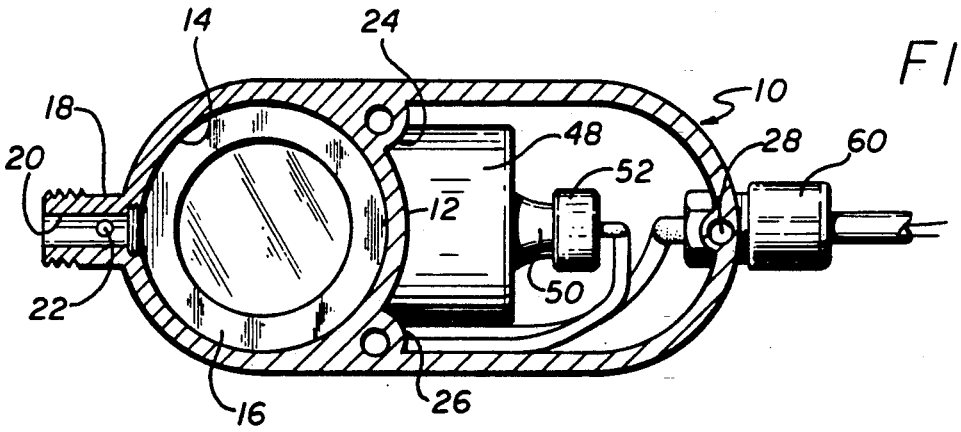
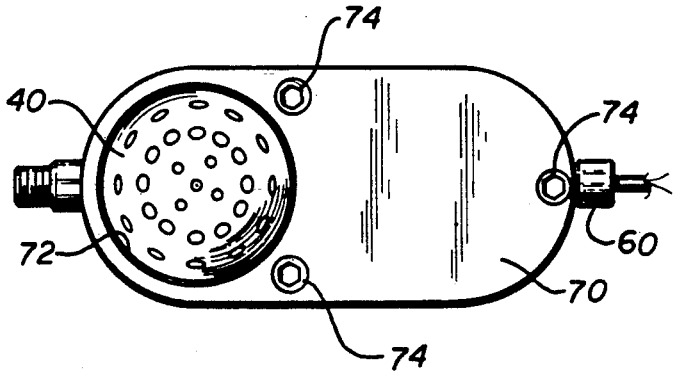
FIG. 4

LIGHTING FIXTURE INCORPORATING FOUNTAIN

BACKGROUND OF THE INVENTION

This invention relates to an illuminated fountain and more particularly to an illuminated fountain which can be made of unusually small size and which is quite inexpensive.

It is well known to provide light in connection with flowing water such as in fountains wherein the light produces an attractive visual effect, particularly when the surrounding area is dark. Examples of prior devices for producing such effects are shown in U.S. Pat. Nos. 492,999; 1,281,869; 1,802,082; 1,839,994; 3,337,133; 4,749,126; 4,901,922; and 4,936,506. Most of the devices shown in these patents are fairly large and elaborate, incorporate a significant number of parts and would be quite expensive to manufacture. Because of the current interest in decorative lighting it is believed that there is a need for an illuminated fountain which is simple, inexpensive, relatively small and safe for the average homeowner to work with.

BRIEF DESCRIPTION OF THE INVENTION

Applicant is provided in an illuminated fountain including a relatively simple and small housing, such as of a cast material such as aluminum, including a water chamber connected to a source of water such as a garden hose, the chamber having a bottom plate of transparent material and a cap with multiple perforations for creating a spray. Any desired pattern of perforations might be used and interchangeable caps having different flow patterns may also be used. A source of illumination such as a lamp is directed to a reflector which reflects light from the lamp through the transparent bottom plate of the water chamber. In this manner the light illuminates the water in the chamber but more particularly it illuminates the small columns of water flowing through the perforations, thus providing a lighted spray with an attractive visual effect. The lamp which is preferably connected to a low voltage wiring system (12 V for example) such as that often used for outdoor illumination, is connected to a pressure responsive switch which responds to pressure of the water delivered to the water chamber to turn on the lamp.

BRIEF DESCRIPTION OF THE DRAWINGS

This invention may be more clearly understood from the following detailed description and by reference to the drawing in which:

FIG. 1 is a perspective view, partly broken away, of the housing used in the illuminated fountain embodying our invention;

FIG. 2 is a top view of the housing of FIG. 1 with some components installed;

FIG. 4 is a top view of the completed fountain depicted in FIG. 3.

DETAILED DESCRIPTION OF THE INVENTION

Figure 3:
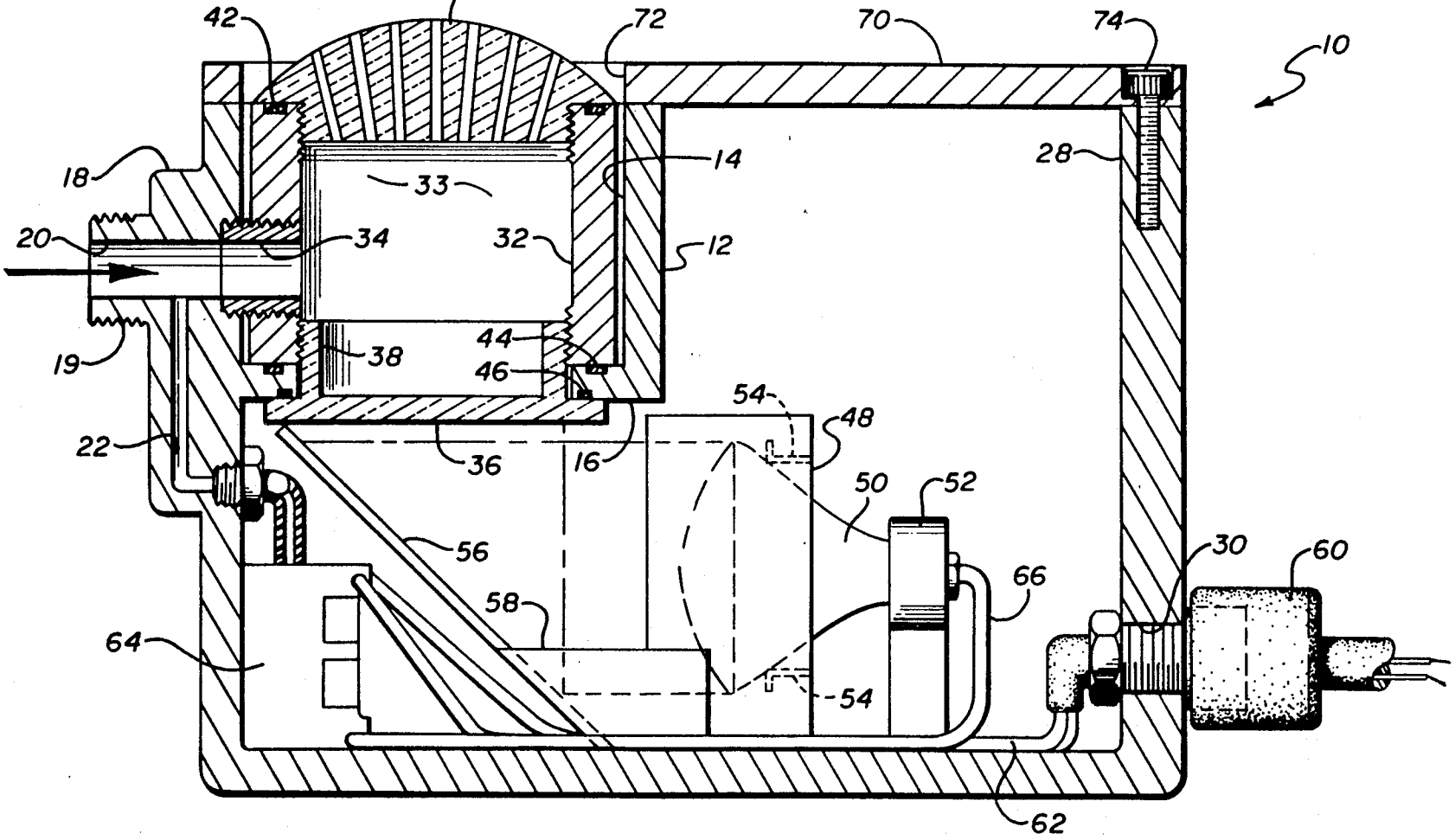
FIG. 3 is a sectional view of the completed illuminated fountain showing the arrangement of internal parts.

FIG. 1 is a perspective view of a housing used for the illuminated fountain according to our invention. In this drawing and in FIG. 2 it will be seen that the housing 10 is in the form of a rectangular box having semi-cylindrical ends which may be of cast aluminum. At one end is an internal cylindrical wall 12 which extends from the top of housing 10 to slightly less than halfway down into the housing from the top, cooperating with the end of housing 10 to form an internal cylindrical chamber 14. At the bottom of wall 12 and extending around the bottom of chamber 14 is a radially-inwardly extending flange 16. Also formed as part of housing 10 is a generally semi-cylindrical projection 18 having attached thereto a boss 19 which includes a passage 20 communicating with the interior of chamber 14, projection 18 also including a second passage 22 which communicates with passage 20 and connects with the inside of housing 10 below chamber 14. Also formed with housing 10 are some thickened wall sections or bosses 24, 26, and 28 which are tapped to receive screws for attaching a cover, not shown in FIGS. 1 and 2. An electrical connector is attached to housing 10 at a port 30.

FIG. 3 is a sectional view of the complete illuminated fountain including the housing 10, the internal wall 12 with flange 16, the water inlet port 20 and the passage 22 communicating water inlet port 20 with the interior of housing 10. Positioned within chamber 14 is a cylindrical member 32 forming the vertical wall of a water chamber 33 and including a port 34 forming an extension of water inlet port 20. Member 32 is internally threaded at its top and bottom. A bottom plate 36 of transparent plastic material such as glass or plastic includes an upstanding cylindrical flange 38 which is externally threaded and which is threadedly engaged with the threaded internal edge of flange 16 and with the threads on the lower internal surface of member 32. A cap member 40 having a desired pattern of passageways therethrough is threadedly engaged with the top of member 32. O-ring seals 42 and 44 are positioned at the top and bottom edge surfaces of member 32. A similar O-ring seal 46 is located between bottom plate 36 and the bottom surface of flange 16. The described seals are effective to prevent water from water chamber 33 from leaking into the lower part of the housing.

Supported in a fixture 48 carried on the bottom of housing 10 is a lamp 50 which is plugged into a socket 52. A plurality of small wire prongs 54 fastened to fixture 48 support lamp 50 in the desired position. Lamp 50, when illuminated, directs light against a reflector 56 such as a mirror which redirects the light through the transparent plate 36 into the water chamber 33. Reflector 56 is supported in the housing 10 at the desired angle by means of a bracket 58 which may be attached to fixture 48.

An electrical connector 60 is connected to housing 10 at port 30 and provides electrical energy to socket 52 from, preferably, a low voltage source such as 12 volts, through wires 62 which are connected to a pressure switch 64 and additional wires 66. Pressure switch 64 is connected with the water pressure source through a conduit 68 fastened to the wall of housing 10 such that it communicates with the conduit 22. Lamp 50 is therefore turned on only when the pressure switch 64 senses water pressure being supplied to water chamber 33.

A cover 70 for housing 10 is shown in FIGS. 3 and 4 and includes a circular opening 72 through which cap 40 protrudes. Cover 70 is secured to housing by means of screws 74 threadedly engaged with the tapped holes in bosses 24, 26, and 28 in housing 10. These screws are easily removed to provide access to the interior of housing 10 to replace lamp 50 without the need to disturb any seals which might affect the water tight integrity of water chamber 33.

From the foregoing it will be appreciated that the illuminated fountain of the present invention is quite simple to manufacture, safe to work with because of the low voltage used and may be made quite compact and compatible in size with other outside lighting fixtures. In one embodiment applicant's housing is less than about 7 inches long, 5 inches high and 3 inches wide. Dimensions will vary with the light source and the particular electrical and water connectors used. The above described embodiments of the present invention are merely descriptive of its principles and are not to be considered limiting. The scope of the present invention instead shall be determined from the scope of the following claims including their equivalents.

What is claimed is:

1. In an illuminated fountain including a molded housing having a top and a bottom, at least one end of which is semi cylindrical, a cylindrical chamber including an internal wall molded in said semi-cylindrical end and located near the top of said housing, said chamber having an open top and an open bottom with a radially inwardly extending flange at the bottom, and a separate member of transparent material located at the bottom of said chamber;

a cylindrical member positioned in said chamber adjacent the internal wall thereof and supported on said flange;

a cap of transparent material covering said cylindrical member and threadedly engaged therewith and a plurality of ports extending through said cap, said separate member, said cylindrical member and said cap constituting a water chamber;

conduit means connecting said water chamber with a source of water under pressure;

a source of electrical power connected to said housing;

a lamp in said housing connected to said electrical power source;

a reflector positioned to receive light from said lamp and direct it toward the bottom of said water chamber, wherein said lamp directs light laterally across said housing toward said semi-cylindrical end, and said reflector is supported at the bottom of said housing and positioned at an angle with respect to the light from said lamp to direct the light from said lamp into said water chamber; and switch means responsive to the presence of water pressure in said conduit means to energize said lamp.

2. An illuminated fountain as claimed in claim 1 wherein said housing includes a cover having an opening surrounding said cap said cover being removable to replace said lamp.

3. An illuminated fountain as claimed in claim 1 wherein seal means are provided between said cylindrical member and said cap and between said radially inwardly extending flange and said separate member of transparent material.

4. An illuminated fountain as claimed in claim 1 wherein said water chamber cap is interchangeable with others having a different pattern of ports for directing water.

5. In an illuminated fountain including a molded housing having a top and a bottom and including a cylindrical chamber having an internal wall and upper and lower open ends with the upper said open end being located near the top of said housing, said lower open end having a radially inwardly extending flange, and a separate member of transparent material located at the lower open end of said chamber including a cylindrical portion adjacent said flange and having external threads;

a cylindrical member positioned in said chamber adjacent the internal wall thereof and having internal threads engaged with said external threads;

a cap of transparent material covering said cylindrical member and threadedly engaged therewith and a plurality of ports extending through said cap; said separate member, said cylindrical member and said cap constituting a water chamber;

conduit means connecting said chamber with a source of water under pressure;

a source of electrical power connected to said housing;

lamp means in said housing connected to said electrical power source;

a reflector positioned to receive light from said lamp means and direct it toward the bottom of said water chamber; and switch means connected to said source of electrical power and responsive to the presence of water pressure in said conduit means to energize said lamp means.

6. An illuminated fountain as claimed in claim 5 wherein said molded housing includes a cover having an opening surrounding said cap said cover being removable to replace said lamp.

7. An illuminated fountain as claimed in claim 5 wherein said water chamber cap is interchangeable with others having a different pattern of ports for directing water.

8. An illuminated fountain as claimed in claim 5 wherein seal means are provided between the upper open end of said cylindrical member and said cap and between said radially inwardly extending flange and said separate member of transparent material.

* * * * *